US011346092B2

(12) United States Patent
Chen et al.

(10) Patent No.: US 11,346,092 B2
(45) Date of Patent: May 31, 2022

(54) FLUSH TOILET

(71) Applicant: TOTO LTD., Kitakyushu (JP)

(72) Inventors: Jing Chen, Fukuoka (JP); Takumi Tsuchitani, Fukuoka (JP); Hiroshi Hashimoto, Fukuoka (JP)

(73) Assignee: TOTO LTD., Kitakyushu (JP)

( * ) Notice: Subject to any disclaimer, the term of this patent is extended or adjusted under 35 U.S.C. 154(b) by 0 days.

(21) Appl. No.: 17/177,233

(22) Filed: Feb. 17, 2021

(65) Prior Publication Data

US 2021/0270028 A1 Sep. 2, 2021

(30) Foreign Application Priority Data

Feb. 28, 2020 (JP) ..... JP2020-034299

(51) Int. Cl.
*E03D 11/06* (2006.01)
*E03D 11/08* (2006.01)

(52) U.S. Cl.
CPC ..... *E03D 11/06* (2013.01); *E03D 11/08* (2013.01)

(58) Field of Classification Search
CPC ..... E03D 11/06; E03D 11/08
See application file for complete search history.

(56) References Cited

U.S. PATENT DOCUMENTS

2019/0153713 A1* 5/2019 Derksen ..... E03D 11/08

FOREIGN PATENT DOCUMENTS

| | | | |
|---|---|---|---|
| JP | 2005-213880 | | 8/2005 |
| JP | 2005231880 A | * | 9/2005 |
| JP | 2010-031551 | | 2/2010 |

OTHER PUBLICATIONS

Translation of JP 2005-213880 (Year: 2005).*

* cited by examiner

*Primary Examiner* — Lauren A Crane
(74) *Attorney, Agent, or Firm* — Amin, Turocy & Watson, LLP

(57) ABSTRACT

A flush toilet according to the embodiment includes a main water guide channel, a downstream-side water guide channel, and a convex part. Through the main water guide channel, flush water supplied from a water supply source flows. The downstream-side water guide channel on a downstream side of the main water guide channel spouts the flush water from a water spout port of the downstream-side water guide channel. The convex part is formed in the downstream-side water guide channel. The convex part includes a first guide part that guides upward the flush water flowing through the downstream-side water guide channel, and a second guide part on a downstream side of the first guide part which guides downward the flush water.

8 Claims, 4 Drawing Sheets

FLUSH TOILET

CROSS-REFERENCE TO RELATED APPLICATION

The present application claims priority to and incorporates by reference the entire contents of Japanese Patent Application No. 2020-034299 filed in Japan on Feb. 28, 2020.

FIELD

An embodiment of the disclosure relates to a flush toilet.

BACKGROUND

Conventionally, there has been known a flush toilet that spouts flush water from its water spout port so as to supply the flush water to a bowl part (see, Japanese Laid-open Patent Publication No. 2010-031551, for example). In the above-mentioned flush toilet, flush water spouted from the water spout port is divided into two main flows of a swirling flow that swirls around the bowl part and a fall flow that flows toward a water retaining part arranged at an under part of the bowl part, so as to discharge waste by using the above-mentioned swirling flow and fall flow.

However, in the conventional technology, a water spout port is formed in flat-shaped and/or a bottom surface of the water spout port is formed to slope downward toward the water retaining part, so as to form the fall flow. Thus, in the conventional technology, a user may easily visually recognize the water spout port that is formed in flat-shaped, for example, so that there presents possibility of deterioration in design.

SUMMARY

A flush toilet according to one aspect of an embodiment includes: a main water guide channel through which flush water supplied from a water supply source flows; a downstream-side water guide channel on a downstream side of the main water guide channel that spouts the flush water from a water spout port of the downstream-side water guide channel; and a convex part formed in the downstream-side water guide channel, wherein the convex part includes: a first guide part that guides upward the flush water flowing through the downstream-side water guide channel; and a second guide part on a downstream side of the first guide part which guides downward the flush water.

The above and other objects, features, advantages and technical and industrial significance of this invention will be better understood by reading the following detailed description of presently preferred embodiments of the invention, when considered in connection with the accompanying drawings.

DESCRIPTION OF EMBODIMENT

Hereinafter, an embodiment of a flush toilet as disclosed in the present application will be described in detail with reference to the accompanying drawings. Additionally, this invention is not limited by an embodiment as illustrated below. Furthermore, the drawings are schematic, so that it has to be noted that a dimensional relationship between respective elements, a ratio between respective elements, or the like may be different from a real one. Among drawings, a part with a mutually different dimensional relationship or ratio may also be included therein.

Overall Configuration of Flush Toilet

Figure 1:
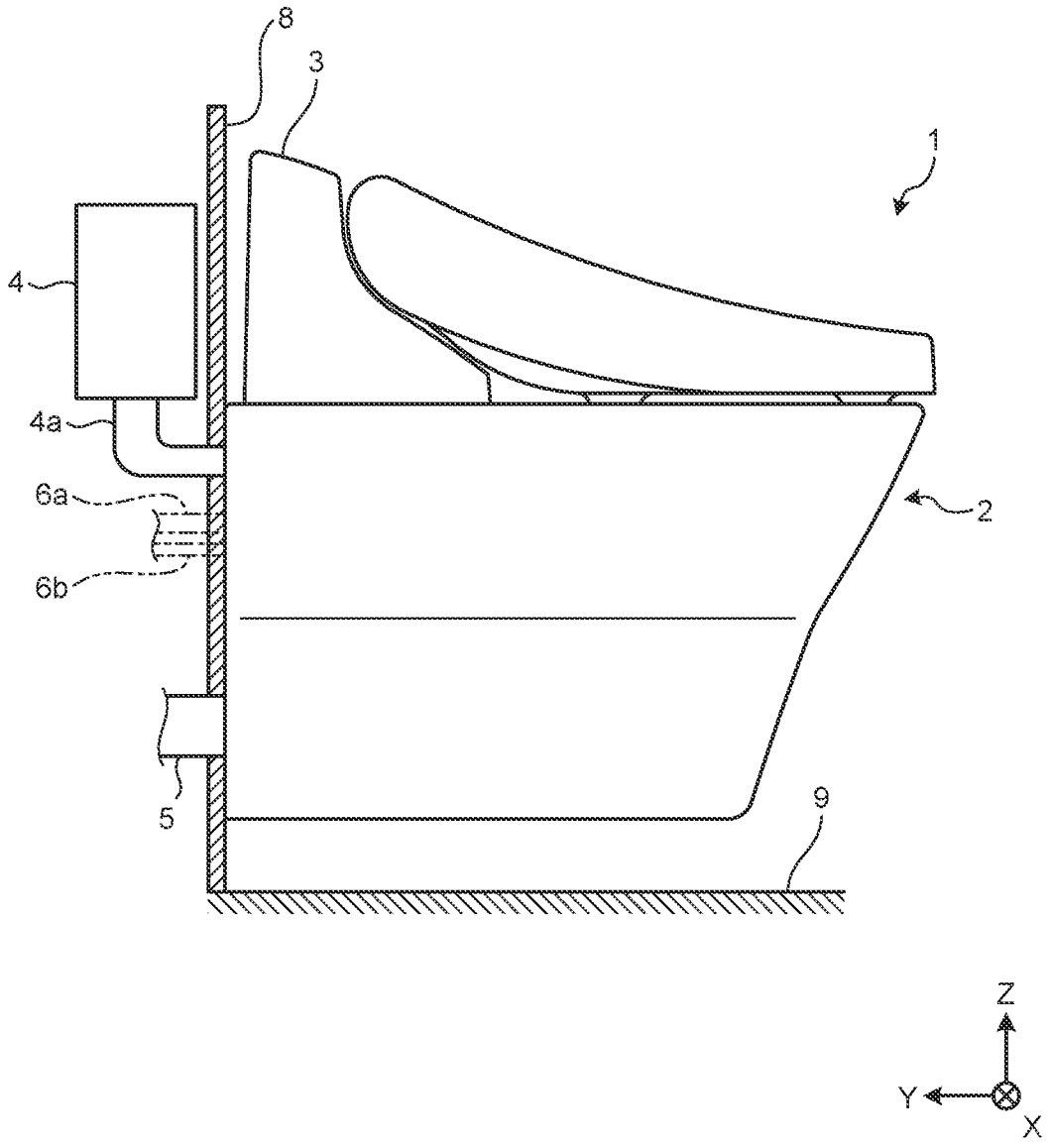
FIG. 1 is a left side view illustrating a flush toilet according to an embodiment.

An overall configuration of a flush toilet 1 according to an embodiment will be explained with reference to FIG. 1. FIG. 1 is a left side view illustrating the flush toilet 1 according to the embodiment. In FIG. 1, a wall surface 8 and a floor surface 9 are indicated in a cross-sectional manner.

In FIG. 1, there is illustrated a three-dimensional orthogonal coordinate system that includes a Z-axis with a positive direction being a vertically upward direction for readily understanding an explanation. Such an orthogonal coordinate system may also be illustrated in another figure. In such an orthogonal coordinate system, a negative direction of a Y-axis, a positive direction of the Y-axis, a positive direction of an X-axis, and a negative direction of the X-axis are respectively defined as a forward direction, a backward direction, a rightward direction, and a leftward direction. Hence, in the following description(s), a direction of the X-axis, a direction of the Y-axis, and a direction of the Z-axis may be respectively referred to as a leftward or rightward direction, a forward or backward direction, and an upward or downward direction.

The flush toilet 1 according to the embodiment is a flush toilet that is mounted on the wall surface 8, i.e. a wall-mounted-type flush toilet. Note that the flush toilet 1 may be a flush toilet that is placed on the floor surface 9, i.e. a floor-mounted-type flush toilet.

The flush toilet 1 includes a toilet body 2 and a private part washing device 3. The flush toilet 1 according to the embodiment is a flush-type toilet (wash-down-type toilet) that washes the toilet body 2 by using flush water supplied from a flush-water supply source so as to discharge waste. Note that the flush toilet 1 may be a siphon-type toilet. The toilet body 2 is made of ceramics, for example. Details of the toilet body 2 will be mentioned later.

The private part washing device 3 includes a washing nozzle, a motor for driving the nozzle, and a motor controller (that are not illustrated). The private part washing device 3 is provided, in order to wash a private part of a user, in an upper part of the toilet body 2 so as to wash a private part of a user by using washing water discharged from the washing nozzle.

In the flush toilet 1, flush water is supplied to the toilet body 2 via a water supplying pipe **4*a* connected with a water storage tank 4 (one example of water supply source). The flush toilet 1 discharges, to a drainage water pipe 5, waste along with flush water. The water storage tank 4 may be arranged behind the toilet body 2 so as to directly supply therefrom flush water to the toilet body 2**.

The flush toilet 1 includes a water supply hose **6*a* that supplies washing water for washing a private part to the private part washing device 3 and a power source cable 6***b* that supplies electric power to the private part washing device 3.

Toilet Body

Figure 2:
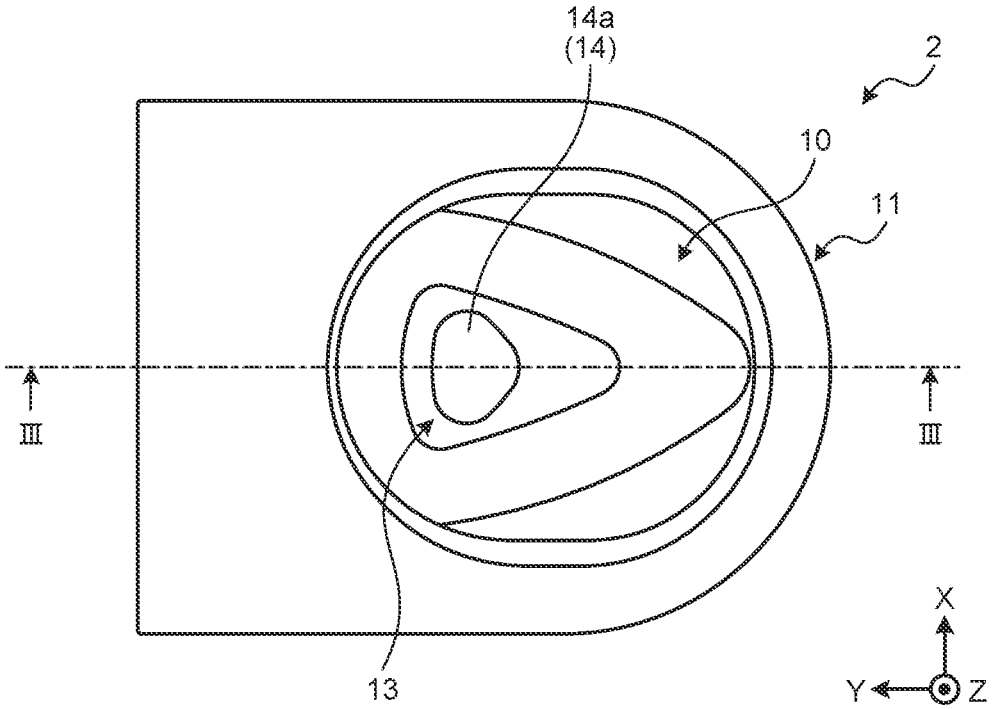
FIG. 2 is a plan view illustrating a toilet body according to the embodiment.
Figure 3:
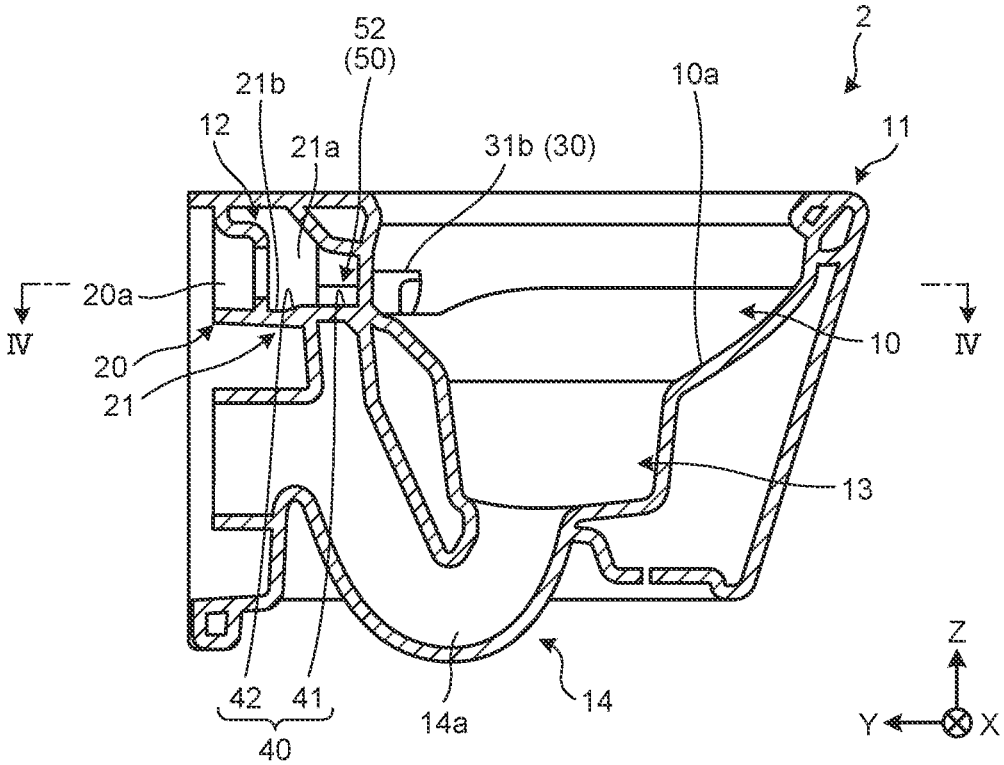
FIG. 3 is a cross-sectional view taken along a line III-III illustrated in FIG. 2.
Figure 4:
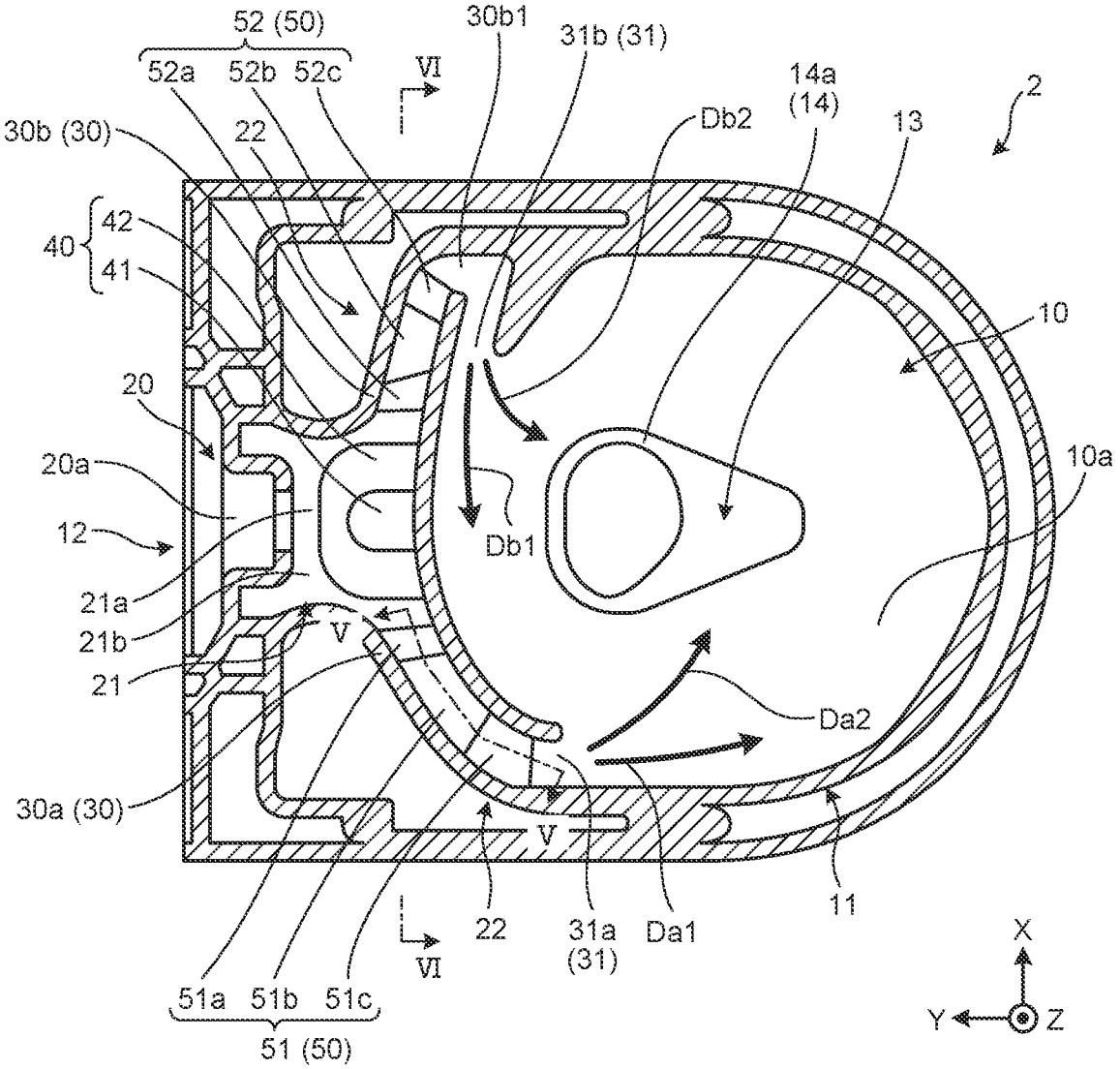
FIG. 4 is a cross-sectional view illustrating the toilet body in a cross section taken along a line IV-IV illustrated in FIG. 3.

Next, the toilet body 2 according to the embodiment will be explained with reference to FIGS. 2 to 4. FIG. 2 is a plan view (top view) illustrating the toilet body 2 according to the embodiment. FIG. 3 is a cross-sectional view taken along a line III-III illustrated in FIG. 2. FIG. 4 is a cross-sectional view illustrating the toilet body 2 in a cross section taken along a line IV-IV illustrated in FIG. 3.

As illustrated in FIGS. 2 to 4, the toilet body 2 includes a bowl part 10, a rim part 11, a water spout part 12 (not illustrated in FIG. 2), a water retaining part 13, and a discharge part 14. The toilet body 2 spouts flush water from the water spout part 12 to discharge waste from the discharge part 14.

The bowl part 10 is formed in bowl-shaped to receive waste. The rim part 11 is arranged at an upper edge of the bowl part 10. The rim part 11 is formed to overhang the inside of the bowl part 10 so that flush water does not splash to the outside.

As illustrated in FIGS. 3 and 4, the water spout part 12 includes a main water guide part 20, a common water guide part 21, and a downstream-side water guide part 22. Note that the above-mentioned "downstream" means a flowing direction of flush water in the water spout part 12. In other words, the above-mentioned "upstream" and "downstream" mean "upstream" and "downstream" of a flow of flush water spouted from the water supplying pipe 4*a* to the bowl part 10.

The main water guide part 20 is connected to the water supplying pipe 4*a* (see FIG. 1), and flush water is supplied from the water supplying pipe 4*a*. Specifically, a main water guide channel 20*a* is formed in the main water guide part 20, and flush water supplied from the water supplying pipe 4*a* flows through the main water guide channel 20*a*. In other words, flush water supplied from the water storage tank 4 (see FIG. 1), which is a water supply source, flows into the main water guide channel 20*a*.

The common water guide part 21 is arranged on a downstream side of the main water guide part 20, and flush water flows into the common water guide part 21 from the main water guide channel 20*a*. Specifically, a common water guide channel 21*a* is formed in the common water guide part 21, and flush water supplied from the main water guide channel 20*a* flows into the common water guide channel 21*a*. Note that a protruding part 40 is formed in the common water guide part 21, which will be mentioned later.

As illustrated in FIG. 4, the downstream-side water guide part 22 is arranged on a downstream side of the common water guide part 21. A plurality of downstream-side water guide channels 30 and a plurality of water spout ports 31 are formed in the downstream-side water guide part 22. For example, the downstream-side water guide channels 30 include a first water guide channel 30*a* and a second water guide channel 30*b*. The water spout ports 31 include a first water spout port 31*a* and a second water spout port 31*b*.

The first water guide channel 30*a* is formed from a rear portion toward a left portion of the bowl part 10 along the rim part 11. The above-mentioned first water spout port 31*a* is formed in an end part on a downstream side of the first water guide channel 30*a*. For example, the first water spout port 31*a* is arranged in the vicinity of the center of the left portion of the rim part 11.

Therefore, flush water flowing from the main water guide channel 20*a* into the first water guide channel 30*a* via the common water guide channel 21*a* flows counterclockwise in the top view, and then spouts from the first water spout port 31*a* into the bowl part 10. In other words, the first water guide channel 30*a* spouts the supplied flush water from the first water spout port 31*a*.

The second water guide channel 30*b* is formed along the rim part 11 in a rear part of the bowl part 10. The second water guide channel 30*b* includes a bending site 30*b*1 that bends a flowing direction of flush water in the middle of its flow path. Specifically, the bending site 30*b*1 of the second water guide channel 30*b* bends a flowing direction of flush water flowing toward the front of the bowl part 10, more specifically, causes the flush water to make a U-turn, so as to guide it to the rear of the bowl part 10. The above-mentioned second water spout port 31*b* is formed in an end part on a downstream side of the second water guide channel 30*b*. The second water spout port 31*b* is arranged at the right rear of the rim part 11, for example.

Therefore, flush water having flowed from the main water guide channel 20*a* to the common water guide channel 21*a* via the second water guide channel 30*b* flows clockwise in the top view, and then a flowing direction thereof is inverted in the bending site 30*b*1 so as to flow counterclockwise. Next, the flush water is spouted counterclockwise from the second water spout port 31*b* to the bowl part 10. In other words, the second water guide channel 30*b* spouts supplied flush water from the second water spout port 31*b*.

As described above, the downstream-side water guide channels 30 are arranged on a downstream side of the main water guide channel 20*a* and the common water guide channel 21*a* so as to spout flush water from the water spout ports 31. The number of the downstream-side water guide channels 30 and the water spout ports 31 is not limited to the above mentioned. In other words, for example, the number of the downstream-side water guide channels 30 and the water spout ports 31 may be one or equal to or more than three. The common water guide channel 21*a* is arranged between the first water guide channel 30*a* and the second water guide channel 30*b* so as to supply flush water having flowed from the main water guide channel 20*a* to the first water guide channel 30*a* and the second water guide channel 30*b*. In other words, in the common water guide part 21, the common water guide channel 21*a* branches into the first water guide channel 30*a* and the second water guide channel 30*b*. Thus, the common water guide part 21 may be referred to as a branching site.

Flush water spouted from the first water spout port 31*a* and the second water spout port 31*b* is divided into swirling flows Da1 and Db1 and fall flows Da2 and Db2 in the bowl part 10, this point will be mentioned later.

Flush water spouted from the first and second water spout ports 31*a* and 31*b* washes the bowl part 10 discharges waste from the drainage water pipe 5 (see FIG. 1) via the water retaining part 13 and the discharge part 14.

As illustrated in FIG. 3, the water retaining part 13 is arranged at an under part of the bowl part 10. A part of flush water is retained in the water retaining part 13 and functions as sealing water so as to prevent a bad smell from the discharge part 14 and the like from flowing back into the bowl part 10. A discharge path 14*a* is formed in the discharge part 14. The discharge path 14*a* is connected with the drainage water pipe 5 (see FIG. 1).

Herein, the protruding part 40 formed in the common water guide part 21 will be explained. As illustrated in FIGS. 3 and 4, the protruding part 40 is formed so as to protrude toward the inside of the common water guide channel 21*a*. Specifically, the protruding part 40 protrudes upward from a bottom surface 21*b* of the common water guide part 21 that forms the common water guide channel 21*a*. The protruding part 40 includes a top part 41 and an inclined part 42.

The top part 41 is formed in planar-shaped. The inclined part 42 is formed so as to connect the top part 41 and the bottom surface 21*b* with each other. The inclined part 42 is formed of slopes falling from the top part 41 in the left-right direction and the forward direction.

Thus, a part of flush water having flowed into the common water guide channel 21*a* collides with the protruding part 40 so as to flow into the first water guide channel 30*a* and the second water guide channel 30*b*. Specifically, the protruding part 40 protrude upward from the bottom surface 21*b* of the common water guide part 21 so as to smoothly change a flowing direction of flush water that is flowing on a side of the bottom surface 21*b* caused by the gravity, and thus the flush water flows into the first water guide channel 30*a* and the second water guide channel 30*b*. Thus, when dividing flush water into the first and second water guide channels 30*a* and 30*b*, the flush toilet 1 is capable of smoothly guiding the flush water into the first and second water guide channels 30*a* and 30*b*.

Incidentally, as described above, when flush water spouted from the first and second water spout ports 31*a* and 31*b* is divided into the swirling flows Da1 and Db1 and the fall flows Da2 and Db2, the flush toilet 1 is capable of efficiently discharging a waste therein.

Specifically, the swirling flows Da1 and Db1 swirl on an outer peripheral side of the bowl part 10, and is capable of efficiently guide a waste adhering to a waste receiving surface 10*a* of the bowl part 10 and the like toward the water retaining part 13. The fall flows Da2 and Db2 push, into the discharge path 14*a* of the discharge part 14, a floating waste floating on a retaining water in the water retaining part 13 and the like, so that it is possible to efficiently discharge a floating waste and the like.

Incidentally, in a conventional technology, in order to form fall flow, a water spout port is formed in flat-shaped, or a bottom surface of a water spout port is formed to slope down toward a water retaining part, for example. However, such a flat-shaped water spout port is easily and visually recognized by a user, so that there presents possibility of deterioration in design.

Thus, the flush toilet 1 according to the present embodiment is configured to form a flow flowing toward the water retaining part 13 regardless of shapes of the first and second water spout ports 31*a* and 31*b*.

Hereinafter, details of the configuration will be explained, as illustrated in FIG. 4, the flush toilet 1 according to the present embodiment includes convex parts 50 that are formed in the respective downstream-side water guide channels 30. Specifically, the convex parts 50 are respectively formed in the first water guide channel 30*a* and the second water guide channel 30*b* that are the downstream-side water guide channels 30. Note that the convex part 50 alone may be formed in one of the first water guide channel 30*a* and the second water guide channel 30*b*.

Hereinafter, the convex part 50 formed in the first water guide channel 30*a* may be referred to as "first convex part 51" and the convex part 50 formed in the second water guide channel 30*b* may be referred to as "second convex part 52", and they may be collectively referred to as "convex parts 50" when explanation is performed without distinction.

For example, the first convex part 51 is formed from a periphery of an upstream-side portion of the first water guide channel 30*a* to the first water spout port 31*a* arranged in a downstream-side portion of the first water guide channel 30*a*. In other words, the first convex part 51 is formed over whole or substantially whole of the first water guide channel 30*a* along a flowing direction of flush water.

The above-mentioned region of the first water guide channel 30*a* in which the first convex part 51 is formed is merely one example, and not limited thereto. In other words, for example, the first convex part 51 may be partially formed in a region on a downstream side of the first water guide channel 30*a*, or may be partially formed in a region on an upstream side of the first water guide channel 30*a*.

For example, the second convex part 52 is formed from a periphery of an upstream-side portion of the second water guide channel 30*b* up to the bending site 30*b*1. Specifically, the second convex part 52 is formed from a periphery of an upstream-side portion of the second water guide channel 30*b* up to a position on an upstream side of a part of the bending site 30*b*1 in which a flowing direction of flush water is bent.

The above-mentioned region of the second water guide channel 30*b* in which the second convex part 52 is formed is merely one example, and not limited thereto. In other words, for example, the second convex part 52 may be partially formed in a region on a downstream side from the bending site 30*b*1 of the second water guide channel 30*b*, or may be formed over whole or substantially whole of the second water guide channel 30*b*.

The first convex part 51 includes a first guide part 51*a*, a straightening part 51*b*, and a second guide part 51*c*. Similarly, the second convex part 52 includes a first guide part 52*a*, a straightening part 52*b*, and a second guide part 52*c*.

Hereinafter, the first convex part 51 will be specifically explained; note that a configuration of the first convex part 51 and that of the second convex part 52 are similar to each other, and thus the following explanation of the first convex part 51 may be basically applied to the second convex part 52.

Figure 5:
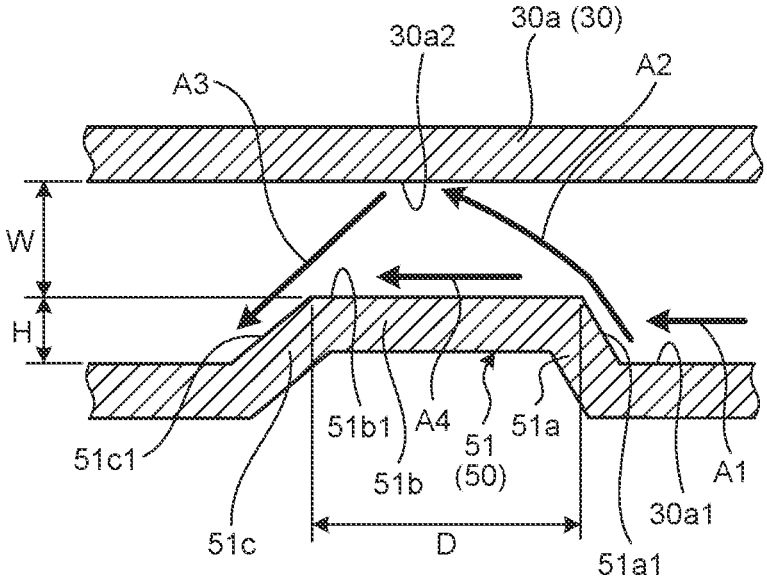
FIG. 5 is a cross-sectional view taken along a line V-V illustrated in FIG. 4.

FIG. 5 is a cross-sectional view taken along a line V-V illustrated in FIG. 4. FIG. 5 is a cross-sectional view illustrating the first convex part 51 that is formed in the first water guide channel 30*a*. As illustrated in FIG. 5, the first convex part 51 is formed so as to protrude toward the inside of the first water guide channel 30*a*. For example, the first convex part 51 is formed so as to protrude upward from a bottom surface 30*a*1 of the first water guide channel 30*a*.

Specifically, the above-mentioned first guide part 51*a* of the first convex part 51 erects upward from the bottom surface 30*a*1 of the first water guide channel 30*a*. In other words, the first guide part 51*a* is a wall part that erects from the bottom surface 30*a*1 of the first water guide channel 30*a*. Specifically, the first guide part 51*a* includes a slope 51*a*1 so as to guide upward, along the slope 51*a*1, flush water flowing through the first water guide channel 30*a*.

The second guide part 51*c* is arranged on a downstream side of the first guide part 51*a*. The second guide part 51*c* also erects upward from the bottom surface 30*a*1 of the first water guide channel 30*a*. In other words, the second guide part 51*c* is a wall part that erects from the bottom surface 30*a*1 of the first water guide channel 30*a*. The second guide part 51*c* includes a slope 51*c*1 so as to guide downward, along the slope 51*c*1, flush water flowing through the first water guide channel 30*a*.

As described above, in the present embodiment, the first water guide channel 30*a* is configured to therein raise flush water by using the first guide part 51*a* and then fall the raised flush water by using the second guide part 51*c*, so that a pressure loss is generated in the flush water caused by the raise and the fall. When such a pressure loss is generated, flush water easily disperses when being spouted from the first water spout port 31*a* of the first water guide channel 30*a*, so as to form, in the bowl part 10, the fall flow Da2 (see FIG. 4) flowing toward the water retaining part 13. In other words, in the present embodiment, it is possible to generate the fall flow Da2 without changing a shape of the water spout port 31 such as the first water spout port 31*a*.

In the first water guide channel 30*a*, the first convex part 51 is arranged in a periphery of the first water spout port 31*a*, and thus flush water having fallen in the second guide part 51*c* is generated at a position near the first water spout port 31*a*. Thus, flush water more easily disperses when being spouted from the first water spout port 31*a*, so that it is possible to reliably generate the fall flow Da2.

The first convex part 51 will be explained more specifically. As described above, the first guide part 51*a* erects upward from the bottom surface 30*a*1 of the first water guide channel 30*a*. Thus, as indicated by using an arrow A1, a part of flush water flowing from the common water guide channel 21*a* collides with the first guide part 51*a* to be guided upward (see arrow A2). Specifically, a part of flush water collides with the slope 51*a*1 to be guided upward along the slope 51*a*1.

In this case, most of flush water guided upward by the first guide part 51*a* collides with a top surface 30*a*2 of the first water guide channel 30*a*. In other words, the first guide part 51*a* is configured to guide upward flush water to form rise flow flowing toward the top surface 30*a*2 of the first water guide channel 30*a*.

As described above, in the present embodiment, a pressure loss is generated in flush water by its collision with the first guide part 51*a*, and thus the flush water disperses when being spouted from the first water spout port 31*a*, so that the fall flow Da2 is easily formed. Moreover, the first guide part 51*a* generates rise flow flowing toward the top surface 30*a*2 so as to reliably form fall flow generated by collision with the top surface 30*a*2, which will be mentioned later.

As described above, when the rise flow collides with the top surface 30*a*2, fall flow flowing downward is generated, which is indicated by an arrow A3. The second guide part 51*c* is provided at a position where the above-mentioned fall flow is generated. The slope 51*c*1 of the second guide part 51*c* slopes down to be along the fall flow that is generated when rise flow having collided with the top surface 30*a*2 falls.

Thus, fall flow falling from the top surface 30*a*2 easily collides with the bottom surface 30*a*1 of the first water guide channel 30*a*, so that it is possible to easily generate a pressure loss in the flush water. The flush water in which the pressure loss is generated easily disperses when being spouted from the first water spout port 31*a*, and thus the fall flow Da2 is easily formed.

The straightening part 51*b* is arranged between the first guide part 51*a* and the second guide part 51*c*. The straightening part 51*b* straightens flush water flowing on an upper surface 51*b*1 so as to form straight flow (see arrow A4).

The straight flow formed in the straightening part 51*b* is to join with fall flow that is falling down from the top surface 30*a*2. Thus, it is possible to direct the above-mentioned fall flow toward the first water spout port 31*a*. Thus, it is possible to cause a large amount of fall flow to collide with the bottom surface 30*a*1 on a side of the first water spout port 31*a* so as to generate therein a pressure loss, and thus it is further possible to generate a flow flowing toward the water retaining part 13 just after flush water is spouted from the first water spout port 31*a*, in other words, the fall flow Da2.

For example, if the first convex part 51 is not provided with the straightening part 51*b*, flush water having gotten over the first convex part 51 becomes flow flowing along a wall surface so as to form turbulent flow, and thus formation of the desired fall flow Da2 is difficult.

Next, a size of the first convex part 51 will be explained. In the first convex part 51, the straightening part 51*b* is formed such that a length D of the straightening part 51*b* in a flowing direction of flush water is larger than a height H of the straightening part 51*b* (namely, D>H).

For example, if the height H of the straightening part 51*b* is too large, there presents possibility that turbulent flow is generated on an upstream side of the straightening part 51*b*; however, when the height H is set as described above, flush water is raised by the first guide part 51*a* and then sufficiently straightened by the straightening part 51*b*, so that it is possible to reliably generate fall flow in the first water guide channel 30*a*.

The straightening part 51*b* is configured such that the length D in a flowing direction of flush water is larger than a distance W from the upper surface 51*b*1 of the straightening part 51*b* to the top surface 30*a*2 of the first water guide channel 30*a* (namely, D>W).

As described above, in the straightening part 51*b*, the length D in a flowing direction of flush water is longer than the distance W up to the top surface 30*a*2, and thus fall flow in the first water guide channel 30*a* easily reaches the straightening part 51*b* or the slope 51*c*1, moreover, it is possible to prevent occurrence of turbulent flow.

For example, a slope angle of the slope 51*a*1 in the first guide part 51*a* is set to larger than a slope angle of a slope 52*c*1 in the second guide part 51*c*. In other words, the slope 51*a*1 is configured such that a slope thereof is steeper than that of the slope 52*c*1. Thus, a part of flush water easily collides with the slope 51*a*1 so as to generate a pressure loss in the flush water, and thus the flush water disperses when being spouted from the first water spout port 31*a* so as to facilitate formation of the fall flow Da2.

In the above description, the case has been exemplified in which a slope angle of the slope 51*a*1 is set to larger than a slope angle of the slope 52*c*1; however, this is merely one example and not limited thereto, for example, a slope angle of the slope 51*a*1 may be set to equal to a slope angle of the slope 52*c*1, or may be set to smaller than a slope angle of the slope 52*c*1.

As illustrated in FIG. 4, the convex parts 50 (first convex part 51 and second convex part 52) that are configured as described above are respectively formed in the first water guide channel 30*a* and the second water guide channel 30*b*.

Thus, fall flow is able to be generated in each of the first water guide channel 30*a* and the second water guide channel 30*b*, so that it is possible to reliably generate the fall flows Da2 and Db2 flowing toward the water retaining part 13.

Note that the first convex part 51 and the second convex part 52 are formed such that shapes thereof are different from each other, not limited thereto, may be formed such that shapes thereof are the same to each other. In other words, between the first convex part 51 and the second convex part 52, for example, any of slope angles of the first guide parts 51*a* and 52*a*, slope angles of the second guide part 51*c* and 52*c*, the lengths D, the heights H, and the distances W up to the top surface 30*a*2 of the straightening parts 51*b* and 52*b*, etc. may be set to different values, or may be set to the same value.

Figure 6:
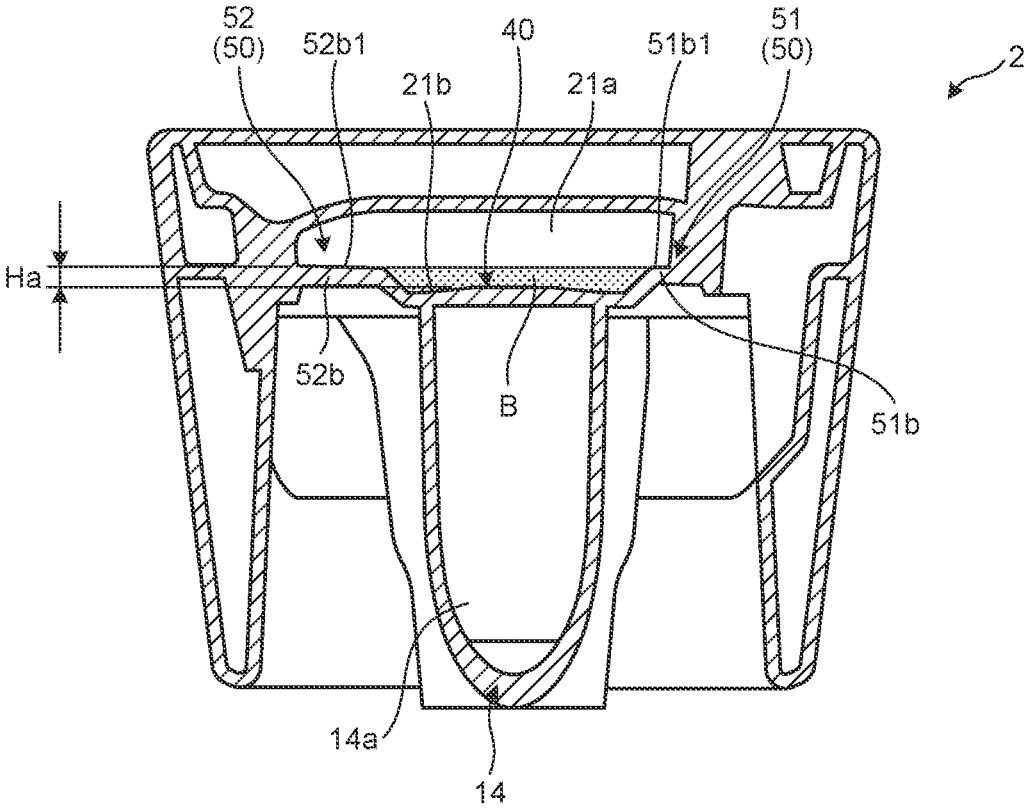
FIG. 6 is a cross-sectional view taken along a line VI-VI illustrated in FIG. 4.

Next, relation between heights of the convex part 50 and the common water guide channel 21*a* will be explained with reference to FIG. 6. FIG. 6 is a cross-sectional view taken along a line VI-VI illustrated in FIG. 4. As illustrated in FIG. 6, the common water guide channel 21*a* is formed such that the bottom surface 21*b* thereof is lower than upper surfaces of the first convex part 51 and the second convex part 52 in the first and second water guide channels 30*a* and 30*b* (in other words, upper surfaces 51*b*1 and 52*b*1 of straightening parts 51*b* and 52*b*) by a predetermined height Ha. Note that the above-mentioned bottom surface 21*b* of the common water guide channel 21*a* includes the protruding part 40.

In accordance therewith, there remains remaining water B in a downstream-side portion of the common water guide channel 21*a*. Therefore, flush water having flowed from the main water guide channel 20*a* (see FIG. 4) collides with a puddle of the remaining water B. Thus, a pressure loss is generated in flush water, and the flush water in which the pressure loss is generated easily disperses when being spouted from the first water spout port 31*a* and the second water spout port 31*b*, so that it is possible to easily generate, in the bowl part 10, the fall flows Da2 and Db2 (see FIG. 4) flowing toward the water retaining part 13.

As described above, the flush toilet 1 according to the embodiment includes the main water guide channel 20*a*, the downstream-side water guide channel 30, and the convex part 50. Through the main water guide channel 20*a*, flush water supplied from a water supply source flows. The downstream-side water guide channel 30 on a downstream side of the main water guide channel 20*a* spouts the flush water from the water spout port 31. The convex part 50 is formed in the downstream-side water guide channel 30. The convex part 50 includes the first guide part 51*a* or 52*a* that guides upward the flush water flowing through the downstream-side water guide channel 30, and the second guide part 51*c* or 52*c* on a downstream side of the first guide part 51*a* or 52*a* which guides downward the flush water. Thus, it is possible to generate, regardless of a shape the water spout port 31, the fall flows Da2 or Db2 that flows toward the water retaining part 13.

Thus, in the downstream-side water guide channel, flush water is raised by the first guide part and then is fallen by the second guide part, and thus a pressure loss is generated in the flush water by the rise and the fall. When such a pressure loss is generated, flush water easily disperses when being spouted from a water spout port of the downstream-side water guide channel, so that fall flow flowing toward a water retaining part is formed in a bowl part. In other words, it is possible to generate fall flow regardless of a shape of the water spout port.

The first guide part is formed such that the first guide part guides upward the flush water to generate rise flow flowing toward a top surface of the downstream-side water guide channel.

As described above, in the first guide part, rise flow flowing toward the top surface is generated, so that it is possible to reliably generate fall flow that is caused by collision with the top surface.

The second guide part includes a slope that slopes down to be along fall flow that is generated when the rise flow having collided with the top surface falls.

Thus, fall flow falling down from the top surface easily collides with a bottom surface of the downstream-side water guide channel, so that it is possible to generate a pressure loss in the flush water. The flush water in which the pressure loss is generated easily disperses when being spouted from the water spout port, so that it is possible to easily generate fall flow that flows toward a water retaining part.

The convex part includes a straightening part between the first guide part and the second guide part. The straightening part straightens the flush water flowing on an upper surface of the straightening part to form straight flow.

As described above, straight flow formed in the straightening part joins with fall flow falling from the top surface. Thus, it is possible to direct the above-mentioned fall flow toward the water spout port. Thus, it is possible to cause a large amount of fall flow to collide with a bottom surface of the downstream-side water guide channel on a side of the water spout port so as to generate therein a pressure loss, and thus it is further possible to generate a flow toward the water retaining part just after flush water is spouted from the water spout port, in other words, the fall flow.

The straightening part is formed such that a length of the straightening part in a flowing direction of the flush water is larger than a height of the straightening part.

Thus, fall flow in the downstream-side water guide channel is able to be reliably generated. In other words, if the height of the straightening part is too large, there presents possibility that turbulent flow is generated on an upstream side of the straightening part; however, when the height is set as described above, flush water is sufficiently straightened by the straightening part after being raised by the first guide part, so that it is possible to reliably generate fall flow in the first water guide channel.

The straightening part is formed such that a length of the straightening part in a flowing direction of the flush water is larger than a distance from the upper surface of the straightening part to a top surface of the downstream-side water guide channel.

Therefore, in the straightening part, a length in a flowing direction of flush water is larger than a distance up to the top surface, and thus fall flow in the downstream-side water guide channel easily reaches the straightening part or the slope, moreover, it is possible to prevent occurrence of turbulent flow.

The downstream-side water guide channel includes: a first water guide channel that spouts the flush water from a first water spout port of the first water guide channel; and a second water guide channel that spouts the flush water from a second water spout port of the second water guide channel, and the convex part is formed in each of the first water guide channel and the second water guide channel.

Thus, fall flow is able to be generated in each of the first water guide channel and the second water guide channel, so that it is possible to reliably generate fall flow flowing toward a water retaining part.

The flush toilet further includes: a common water guide channel between the first water guide channel and the second water guide channel, the common water guide channel supplying the flush water from the main water guide channel to the first water guide channel and the second water guide channel, wherein the common water guide channel is formed such that a bottom surface of the common water guide channel is lower than an upper surface of the convex part of each of the first water guide channel and the second water guide channel.

In accordance therewith, there remains remaining water in a downstream-side portion of the common water guide channel. Therefore, flush water having flowed from the main water guide channel collides with a puddle of the remaining water. Thus, a pressure loss is generated in flush water, and the flush water in which the pressure loss is generated easily disperses when being spouted from the first water spout port, so that it is possible to easily generate, in a bowl part, the fall flow flowing toward the water retaining part.

Additional advantages and modifications will readily occur to those skilled in the art. Therefore, the invention in its broader aspects is not limited to the specific details and representative embodiments shown and described herein.

Accordingly, various modifications may be made without departing from the spirit or scope of the general inventive concept as defined by the appended claims and their equivalents.

What is claimed is:

1. A flush toilet comprising:

a main water guide channel through which flush water supplied from a water supply source flows;

a downstream-side water guide channel on a downstream side of the main water guide channel that spouts the flush water from a water spout port of the downstream-side water guide channel; and a convex part formed in the downstream-side water guide channel, wherein the convex part includes:

a first guide part that guides upward the flush water flowing through the downstream-side water guide channel; and a second guide part on a downstream side of the first guide part which guides downward the flush water, and a slope angle of the first guide part is larger than a slope angle of the second guide part.

2. The flush toilet according to claim 1, wherein the first guide part is formed such that the first guide part guides upward the flush water to generate rise flow flowing toward a top surface of the downstream-side water guide channel.

3. The flush toilet according to claim 2, wherein the second guide part includes a slope that slopes down to be along fall flow that is generated when the rise flow having collided with the top surface falls.

4. The flush toilet according to claim 1, wherein the convex part includes a straightening part between the first guide part and the second guide part, the straightening part straightening the flush water flowing on an upper surface of the straightening part to form straight flow.

5. The flush toilet according to claim 4, wherein the straightening part is formed such that a length of the straightening part in a flowing direction of the flush water is larger than a height of the straightening part.

6. The flush toilet according to claim 4, wherein the straightening part is formed such that a length of the straightening part in a flowing direction of the flush water is larger than a distance from the upper surface of the straightening part to a top surface of the downstream-side water guide channel.

7. A flush toilet comprising:

a main water guide channel through which flush water supplied from a water supply source flows;

a downstream-side water guide channel on a downstream side of the main water guide channel that spouts the flush water from a water spout port of the downstream-side water guide channel; and a convex part formed in the downstream-side water guide channel, wherein the convex part includes:

a first guide part that guides upward the flush water flowing through the downstream-side water guide channel; and a second guide part on a downstream side of the first guide part which guides downward the flush water, wherein the downstream-side water guide channel includes:

a first water guide channel that spouts the flush water from a first water spout port of the first water guide channel; and a second water guide channel that spouts the flush water from a second water spout port of the second water guide channel, and the convex part is formed in each of the first water guide channel and the second water guide channel.

8. The flush toilet according to claim 7 further comprising:

a common water guide channel between the first water guide channel and the second water guide channel, the common water guide channel supplying the flush water from the main water guide channel to the first water guide channel and the second water guide channel, wherein the common water guide channel is formed such that a bottom surface of the common water guide channel is lower than an upper surface of the convex part of each of the first water guide channel and the second water guide channel.

* * * * *